US006946037B2

(12) United States Patent
Serve et al.

(10) Patent No.: US 6,946,037 B2
(45) Date of Patent: Sep. 20, 2005

(54) SILICONE REMOVER

(75) Inventors: Wilfried Serve, Leverkusen (DE); Siegfried Bragulla, Monheim (DE)

(73) Assignee: Ecolab GmbH & Co. OHG, Dusseldorf (DE)

( * ) Notice: Subject to any disclaimer, the term of this patent is extended or adjusted under 35 U.S.C. 154(b) by 125 days.

(21) Appl. No.: 10/276,200

(22) PCT Filed: Apr. 28, 2001

(86) PCT No.: PCT/EP01/04824

§ 371 (c)(1),
(2), (4) Date: Feb. 27, 2003

(87) PCT Pub. No.: WO01/85885

PCT Pub. Date: Nov. 15, 2001

(65) Prior Publication Data

US 2003/0162676 A1 Aug. 28, 2003

(30) Foreign Application Priority Data

May 9, 2000 (DE) ..... 100 22 419

(51) Int. Cl.[7] ..... B08B 3/04; C11D 1/72; C11D 3/30; C11D 3/39

(52) U.S. Cl. ..... 134/40; 510/245; 510/254; 510/369; 510/372; 510/421; 510/506

(58) Field of Search ..... 510/245, 254, 510/369, 372, 421, 506; 134/40, 41, 42

(56) References Cited

U.S. PATENT DOCUMENTS

| | | | |
|---|---|---|---|
| 3,234,258 | A | 2/1966 | Morris |
| 4,539,134 | A | 9/1985 | Martin et al. |
| 5,075,041 | A | 12/1991 | Lutz |

FOREIGN PATENT DOCUMENTS

| | | |
|---|---|---|
| DE | 42 28 786 | 3/1994 |
| DE | 43 24 152 | 1/1995 |
| GB | 2 282 607 | 4/1995 |
| WO | WO 92/18600 | 10/1992 |
| WO | WO0012661 | * 3/2000 |

OTHER PUBLICATIONS

Patent Abstracts of Japan JP 08–199472, Aug. 6, 1996.
Patent Abstracts of Japan 06–73394, Mar. 15, 1994.

* cited by examiner

*Primary Examiner*—Gregory R. Del Cotto
(74) *Attorney, Agent, or Firm*—Merchant & Gould P.C.

(57) ABSTRACT

The invention relates to the use of a surface-active agent and to the use of cleaning agents obtained by dilution of said surface-active agent for removing silicone-containing deposits from surfaces.

16 Claims, No Drawings

SILICONE REMOVER

This present invention relates to the use of a surfactant composition and to the use of cleaning solutions which are obtainable by dilution of the surfactant composition for removal of silicone-containing residues from surfaces.

A large number of various silicones are employed in industry, in particular in the cosmetics, pharmaceuticals, biotechnology and foodstuffs-processing industry. These silicones are employed, for example, as defoamers, lubricants and slip agents, or as skin protection and care components in lotions, creams, sunscreen compositions and make-up and as hair protection in hair shampoo.

Further examples of the uses of silicones are the use as additives in lacquers and printing inks for improving the wettability on plastics, as an additive to domestic cleaning compositions and care compositions, also for better wetting, or as a defoamer in the paper industry. The use of silicones finds very wide application in industry. The most diverse silicones are employed, depending on the field of use. These may be divided into the following groups:

Linear polysiloxanes, branched polysiloxanes, cyclic polysiloxanes, crosslinked polymers.

Within each polymer group another classification may be made according to the nature of the substituents bonded to the silicon. The silicones may be low- to high-viscosity or solid, depending on the chain length, degree of branching and substituents.

Since silicones are contained in a large number of products, such as sunscreen compositions, creams, make-up and medicaments, the production units, such as mixer and homogenizer, fermenter, storage tanks, lines and filling machines, must be cleaned after use for hygiene reasons. In the case of a product change on a production line in particular, all the previous product constituents must be removed thoroughly by chemical cleaning, in order to avoid contamination of the subsequent production batch with residues of the previous production.

High-alkalinity and/or acid cleaning compositions are conventionally used for automatic chemical cleaning by means of CIP units (cleaning in place) or in pumped circulation or immersion processes. In some cases, cleaning is carried out manually by means of wiping or using solvents, such as benzene, toluene and aliphatic, and also chlorinated, hydrocarbons.

Some silicones may already be removed from the units using 1% sodium hydroxide solution, depending on the type of silicone. However, most silicones may be removed only by using 10 per cent or higher sodium hydroxide solution. In addition, there are also silicones which cannot be removed using these highly alkaline solutions. In these cases, the silicone must be removed from the units by manual wiping using cloths or by using solvents.

The very high concentrations of alkaline cleaning compositions must be neutralized before introduction into the sewage system, so that the particular local regulations for waste water are achieved. As a consequence, a neutralization basin must be available, and furthermore neutralizing agents must be employed. The salt load of the waste water is increased as a result.

If solvents are used, these must be collected separately and treated as special waste. In addition, handling of solvents is hazardous in many cases for toxicological reasons.

The problems of the poor ease of removal of silicone residues accordingly often involve high costs and unnecessary pollution of the environment. There is therefore a need in industry to optimize the cleaning power with respect to silicone residues by using suitable compositions.

An object of the present invention was accordingly to search for selected compositions by the use of which it is possible to remove silicone-containing residues without necessitating the use of pure solvents or manual wiping of the contaminated surfaces.

This object has been achieved, surprisingly, by the use of selected surfactants. The present invention thus relates to the use of a surfactant composition which comprises one or more hydrophilic components selected from:

(a) the group of nonionic surfactants corresponding to general formula (I):

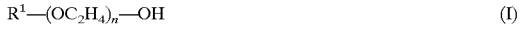

$$R^1—(OC_2H_4)_n—OH \quad (I)$$

wherein $R^1$ represents a straight- or branched-chain alkyl or alkenyl radical having 8 to 22 carbon atoms and the average degree of ethoxylation n is between 14 and 40; and/or corresponding to general formula (II):

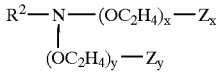

$$R^2—N(—(OC_2H_4)_x—Z_x)(—(OC_2H_4)_y—Z_y) \quad (II)$$

wherein $R^2$ represents a straight- or branched-chain alkyl or alkenyl radical having 8 to 22 carbon atoms, $Z_x$ and $Z_y$ represent hydroxyl groups and the average degree of ethoxylation, the sum of x and y, is between 5 and 25, where, when x or y represents 0, the corresponding $Z_x$ or $Z_y$ represents H;

and/or (b) the group of alkyl sulfates having 8 to 22 carbon atoms in the alkyl group;

and additionally at least one component selected from:

(c) the groups of alkyl phosphate salts and/or alkylphenol ethoxylates having an average degree of ethoxylation of 6 to 14 and having in each case 8 to 22 carbon atoms in the alkyl group;

and/or (d) the group of alkyl-amine oxides having in each case 8 to 22 carbon atoms in the alkyl group;

and/or (e) the group of nonionic surfactants corresponding to general formula (III):

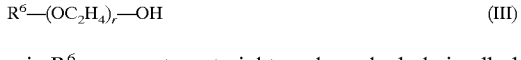

$$R^6—(OC_2H_4)_r—OH \quad (III)$$

wherein $R^6$ represents a straight- or branched-chain alkyl or alkenyl radical having 8 to 22 carbon atoms and the average degree of ethoxylation r is 1 to 7;

for removal of silicone-containing residues from surfaces.

The alcohols having 8 to 22 carbon atoms are of natural or synthetic origin, which, for economic reasons, are also accessible on a large industrial scale, in particular naturally occurring alcohols from the hydrogenation of carboxylic acids or carboxylic acid derivatives of plant or animal origin (so-called fatty alcohols), may be employed as alcohols of which ethoxylation gives the nonionic surfactants.

The alcohols accessible from industrial alcohol syntheses, such as oxo alcohols and Ziegler alcohols, may also be used.

The alcohols here are, in particular, primary alcohols preferably having 8 to 18 carbon atoms, in which the alcohol radical may be linear or preferably methyl-branched in the 2-position or may contain a mixture of methyl-branched radicals, such as are usually present in oxo alcohol radicals. In preferred ethoxylated nonionic surfactants (I) the alcohol radical is even narrower in its chain distribution, ethoxylated tallow alcohol particularly preferably being used as the nonionic surfactant (I). position The average degree of ethoxylation for the ethoxylated nonionic surfactants (I) is between 14 and 40, preferably between 25 and 35, and particularly preferably 30, such as is present, for example, in the surfactant DEHYDOL® TA 30 from COGNIS.

The degrees of ethoxylation stated are statistical average values which may be an integer or a fraction for a specific product. Preferred alcohol ethoxylates have a narrowed distribution of homologues (narrow range ethoxylates, NRE).

The nonionic surfactants (II) are also termed ethoxylated fatty amines. In these, the sum of x and y is preferably between 6 and 18, and particularly preferably between 8 and 14. It is furthermore preferable that the radical $R^2$ represents a straight- or branched-chain alkyl or alkenyl radical having 8 to 18 carbon atoms.

Typical examples are addition products of, on average, 5 to 25, preferably 6 to 18, and particularly preferably 8 to 14 mol of ethylene oxide on caprylamine, caprylylamine, caproylamine, laurylamine, myristylamine, cetylamine, stearylamine, isostearylamine, oleylamine, elaidylamine, petroselinylamine, behenylamine and erucylamine and mixtures thereof. The ethoxylates here may have a conventionally wide or a narrowed distribution of homologues.

Preferred alkyl sulfates (b) are the alkali metal, and in particular the sodium, salts of sulfuric acid half-esters of $C_8$–$C_{18}$ fatty alcohols, for example of coconut fatty alcohol, tallow fatty alcohol, lauryl, myristyl, cetyl or stearyl alcohol or the $C_{10}$–$C_{20}$ oxo alcohols and those half-esters of secondary alcohols of these chain lengths. Alkyl sulfates of the chain length mentioned which contain a synthetic straight-chain alkyl radical prepared on a petrochemical basis and have analogous degradation properties, such as the suitable compounds based on fatty-chemical raw materials, are furthermore preferred. For cleaning technology reasons the $C_{12}$–$C_{16}$ alkyl sulfates and $C_{12}$–$C_{15}$ alkyl sulfates and $C_{14}$–$C_{15}$ alkyl sulfates are preferred. 2,3-alkyl sulfates which are prepared, for example, according to U.S. Pat. Nos. 3,234,258 or 5,075,041 and may be obtained as commercial products from Shell Oil Company under the name DAN®, are also suitable alkyl sulfates.

Substances corresponding to general formula (IV):

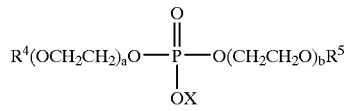

(IV)

wherein $R^4$ and $R^5$ independently represent alkyl and/or alkenyl radicals having 8 to 22 carbon atoms, preferably 8 to 18 carbon atoms; X represents an $R^4(OCH_2CH_2)_a$ group, hydrogen or an alkali metal; and the sum of a and b is between 6 and 14, particularly preferably between 8 and 12, where a or b may also be 0; are preferably employed as alkyl phosphates (c). These substances are also known anionic surfactants which are conventionally obtained by reaction of optionally ethoxylated alcohols with phosphorus pentoxide. Typical examples are technical-grade mixtures of mono- and di-alkyl phosphates based on fatty alcohols having 8 to 22, preferably 10 to 18, and in particularly preferably 12 to 18 carbon atoms. Instead of the alcohol, adducts thereof with the corresponding number of moles of ethylene oxide may also be employed. The alkyl phosphates are preferably present in the form of the sodium salts thereof.

In another preferred embodiment, there is at least one salt of a phosphoric acid partial ester among the alkyl phosphates employed, at least one alkali metal salt of a phosphoric acid partial ester of an alkoxylated alkylphenol particularly preferably being present.

In this context, the phosphoric acid esters are surfactant substances which are preferably derived from long-chain aliphatic or araliphatic alcohols. The salts of the phosphoric acid partial esters, and here in particular those of alkoxylated alkylphenols, have proved to be useful in this case, depending on the field of use. The sodium and potassium salts are preferably used as the alkali metal salts, and of these in turn the potassium salts are particularly preferred. Phosphoric acid partial esters having a surfactant action such as are preferably used according to the present invention, are commercially available. An example of an active compound of this type which is particularly suitable for the present use is the product Triton® H 66 (Röhm & Haas).

The alkylphenol ethoxylates (c) preferably have 8 to 15 carbon atoms in the alkyl group, and in a further preferred embodiment an average degree of ethoxylation of 8 to 12.

Preferred alkylamine oxides (d) are trialkylamine oxides having an alkyl group containing 8 to 22 carbon atoms and two alkyl groups having a lower number of carbon atoms in the alkyl chain, it being possible for the two shorter alkyl groups to be the same or different, and it being particularly preferable to employ as the alkylamine oxide tallow fatty-bis-(2-hydroxyethyl)-amine oxide, oleyl-bis-(2-hydroxyethyl)-amine oxide, coconut-bis-(2-hydroxyethyl)-amine oxide, tetradecyldimethyl-amine oxide and/or alkyldimethyl-amine oxide which contains 12 to 18 carbon atoms in the alkyl chain.

The alcohols having 8 to 22 carbon atoms, preferably 8 to 18 carbon atoms, of natural or synthetic origin which, for economic reasons, are also accessible on a large industrial scale, in particular naturally occurring alcohols from the hydrogenation of carboxylic acids or carboxylic acid derivatives (so-called fatty alcohols), may be employed as alcohols of which ethoxylation gives the nonionic surfactants (III).

The alcohols accessible from industrial alcohol syntheses, such as oxo alcohols and Ziegler alcohols, may also be used.

The alcohols here are, in particular, primary alcohols preferably having 8 to 18 carbon atoms, in which the alcohol radical may be linear or preferably methyl-branched in the 2-position or may contain a mixture of methyl-branched radicals, such as are usually present in oxo alcohol radicals. In preferred ethoxylated nonionic surfactants (III), the alcohol radical is even narrower in its chain distribution.

The average degree of ethoxylation for the ethoxylated nonionic surfactants (III) is between 1 and 7, preferably between 3 and 7, and very particularly preferably about 5.

The degrees of ethoxylation stated are statistical average values which may be an integer or a fraction for a specific product. Preferred alcohol ethoxylates have a narrowed distribution of homologues (narrow range ethoxylates, NRE).

In a preferred embodiment, in the composition to be used according to the present invention, the sum of components (a) and (b) makes up 0.1 to 33 wt. %, preferably 1 to 20 wt. %, particularly preferably 2 to 15 wt. %, and the sum of components (c), (d) and (e) makes up in total 0.1 to 67 wt. %, preferably 1 to 40 wt. %, particularly preferably 2 to 30 wt. %, based on the total composition, it also being possible for the content of individual components to be 0, and the remainder to make up 100 wt. % optionally being water and/or further auxiliary substances and/or active compounds.

It is preferable that in the composition to be used according to the present invention, the weight ratio of (a+b):(c+d+e) in the mixture is between 4:1 and 1:8, particularly preferably between 2:1 and 1:4.

It was not disclosed anywhere in the prior art that precisely by the present use of the surfactants described, an outstanding silicone-removing action is to be achieved.

The present use is preferably carried out by separate addition of the compositions to be used according to the present invention during a cleaning process, as a cleaning booster, or by addition of the compositions to be used according to the present invention in the preparation of cleaning compositions.

It is preferable here if the cleaning takes place in an alkaline medium.

In a preferred embodiment, the surfactant composition to be used according to the present invention comprises additional components with complexing properties and/or solubilizing agents and/or surface-active components.

The components having complexing properties are preferably selected from nitrilotriacetic acid, ethylenediaminetetraacetic acid, methylglycine-diacetic acid, gluconic acid, citric acid, dicarboxymethyl-L-glutamic acid, serine-diacetic acid, imidosuccinic acid and the group of polycarboxylic acids and phosphonic acids and in each case salts thereof.

Possible polycarboxylic acids are, for example, polyacrylic acids and copolymers of maleic anhydride and acrylic acid, and the sodium salts of these polymer acids. Commercially available products are e.g. Sokalan® CP 5 and PA 30 from BASF, Alcosperse® 175 and 177 from Alco and LMW® 45 N and SPO2 ND from Norsohaas. Suitable naturally occurring polymers include, for example, oxidized starch (e.g. DE 42 28 786) and polyamino acids, such as polyglutamic acid or polyaspartic acid, e.g. from Cygnus, Bayer, Röhm & Haas, Rhône-Poulenc or SRCHEM.

Possible phosphonic acids are, for example, 1-hydroxyethane-1,1-diphosphonic acid, diethylenetriaminepentamethylenephosphonic acid or ethylenediaminetetramethylenephosphonic acid and in each case alkali metal salts thereof.

The components having complexing properties are particularly preferably selected from nitrilotriacetic acid, polyaspartic acid or polyearboxylic acids which are preferably based on polymerization of aspartic acid with other carboxylic acids, as well as gluconic acid.

Additional solubilizing agents are preferably selected from the group of anionic surfactants, very particularly preferably from the sulfonates/sulfonic acids, and in particular from cumene-, xylene-, octyl-, naphthyl- and alkylbenzenesulfonates/sulfonic acids, in the latter case the alkyl group containing between 6 and 16 carbon atoms, or mixtures of these compounds and/or further compounds which act as solubilizing agents.

Additional solubilizing agents may equally preferably be selected from the groups of liquid alcohols, more preferably glycol ethers, most preferably butyldiglycol, or alcohols having comparable properties.

Caprylic acid or salts thereof may, moreover, be preferred as an additional solubilizing agent.

Preferred additional surface-active components are selected from the groups of anionic, cationic, nonionic and amphoteric surfactants, protein hydrolysates, silicone compounds and phosphoric acid esters and salts thereof, if they are not already covered by the explanations given so far.

The surfactant compositions to be used according to the present invention may comprise further alkoxylated alkyl alcohols having 8 to 22 carbon atoms in the alkyl chain as nonionic surfactants in addition to the compounds (I) and (III), and they preferably comprise at least one compound from the groups of mixed ethoxylates/propoxylates of branched or unbranched alkyl alcohols having 8 to 22 carbon atoms in the alkyl chain and ethoxylates, having closed end groups, of branched or unbranched alkyl alcohols having 8 to 22 carbon atoms in the alkyl chain, and very particularly preferably at least one compound from the groups of ethoxylated and propoxylated alkyl alcohols having 12 to 22 carbon atoms in the alkyl part, butyl ethers of ethoxylated alkyl alcohols having 12 to 22 carbon atoms in the alkyl part and methyl ethers of ethoxylated alkyl alcohols having 12 to 22 carbon atoms in the alkyl part, and they comprise the butyl ether and methyl ether of ethoxylated 2-octyl-1-dodecanol in the specific case.

Nonionic surfactants which are particularly well suited for the preparation of formulations for the present use are, for example, Plurafac® LF 403 and Plurafac® 431 from BASF and Dehypon® LT 104, Dehypon® LST 254, Dehypon® LS 54 and Dehypon® G 2084 from COGNIS. Degressal® SD 20 from BASF may be mentioned here as a further surfactant having good defoaming properties which is additionally to be preferred.

Preferred application forms of the surfactant compositions to be used according to the present invention are aqueous solution, gel, emulsion, paste, dispersion, solid shaped body and powder.

It is also preferable here to contact the surfactant compositions to be used according to the present invention with the surfaces to be cleaned in a concentrated or dilute form by the immersion process or by filling the object to be disinfected and/or via application aids.

Preferred application aids are sponge, cloth, rag, brush, wiper, rubber, spraying device and foaming device.

Cleaning and disinfecting may preferably be carried out simultaneously by using the surfactant compositions to be used according to the present invention.

For removal of silicone-containing residues from surfaces it is furthermore preferable to employ a cleaning solution which is obtainable by diluting the composition to be used according to the present invention with water, which optionally contains further auxiliary substances and/or active compounds, by a dilution factor of 1:5 to 1:10,000, preferably 1:20 to 1:1,000.

The cleaning solution obtainable in this way preferably comprises, based on the total cleaning solution, (a) a total of 0.00001 to 6.5 wt. % of components (a)+(b), in addition to 0.00001 to 13 wt. % of components (c)+(d)+(e), it also being possible for the content of individual components to be zero;

and (b) 0.05 to 10 wt. % alkali metal hydroxide;

(c) 0.03 to 5 wt. % of an agent having complexing properties;

(d) optionally 0.03 to 5 wt. % solubilizing agents;

and (e) optionally further low-foam surfactants.

It is furthermore preferable that the surfactant composition to be used according to the present invention or the cleaning solution is pumped in circulation and/or sprayed in the unit manually or in an automatic system, the use temperatures being between 0 and 80° C. and the pumping and/or spraying times being between 5 and 60 minutes, and the unit surfaces optionally being disinfected in a further step after the treatment has taken place and thereafter being rinsed with water of drinking water quality.

It is furthermore preferable to add hydrogen peroxide to the surfactant composition or the cleaning solution in order further to increase the silicone-removing properties.

EXAMPLES

Because of the large number of silicones, a silicone combination which is particularly difficult to remove was determined in preliminary experiments. The procedure here was such that various silicone combinations were applied to high-grade steel sheets (5×10 cm) and left at 25° C. for 24 h. Thereafter, the contaminated sheets were immersed in 10% NaOH solution 12 times a minute over a period of 20 minutes. The experiments were carried out by means of a fully automatic immersion apparatus. The removal properties under these conditions were then determined gravimetrically.

It was found here that a silicone oil mixture of cyclomethicone, dimethiconol and dimethicones was the most difficult to remove. Under the conditions mentioned, a removal of material of only 26% was found by gravimetry.

All further experiments were carried out using this test contamination.

To prepare the test sheets, the test contamination was applied to high-grade steel sheets (5×10 cm) and left there at 25° C. for 24 h. Thereafter, the sheets having contamination standardized in this manner were immersed in various surfactant-containing alkaline 0.5% NaOH-containing cleaning solutions 12 times a minute over a period of 20 minutes. The experiments were carried out by means of a fully automatic immersion apparatus. The removal properties under these conditions were then determined gravimetrically.

The combinations of surfactant compositions used for the preparation of the cleaning solutions can be seen from Table 1.

TABLE 1

Surfactant combinations in 0.5% aqueous NaOH solution for investigations in respect of silicon-removing properties

| Surfactant raw material | No. of the surfactant combination and percentage content of the surfactant in 0.5% aqueous NaOH solution | | | | | | | | | | | | | |
|---|---|---|---|---|---|---|---|---|---|---|---|---|---|---|
| | V1 | V2 | V3 | 1 | 2 | 3 | 4 | 5 | 6 | 7 | 8 | 9 | 10 | 11 |
| Alkyl sulfate Na salt $C_{12}$ | | | 0.1 | 0.2 | | | | | | | | | | |
| Fatty alcohol ethoxylate having 5 EO (emulsifier) | | | | 0.2 | | 0.2 | 0.2 | | | | | | | |
| Fatty alcohol ethoxylate, tallow in the alkyl group and 30 EO | 0.2 | | 0.1 | | 0.2 | 0.2 | | 0.1 | 0.1 | | 0.1 | | | |
| Oleic acid ethoxylate | | | | | 0.2 | | | | | | | | | 0.1 |
| Coconut fatty amine having 12 EO | 0.2 | | 0.1 | | | | 0.2 | | | 0.1 | | 0.1 | 0.1 | 0.1 |
| Octylphenol ethoxylate having 9/10 EO | | 0.1 | | | | | | 0.1 | | | | | | |
| Alkylphenol phosphoric acid partial ester in salt form | | 0.1 | | | | | | | 0.1 | | 0.1 | | | |
| Dimethyl-coconut alkylamine oxide | | | | | | | | | | 0.1 | | 0.1 | | 0.1 |
| Surfactant mixture of: glyceryl stearates, ceteareth-20 and 12, ceteacryl alcohol and cetyl palmitate $C_{16}$ | | | | | | | | | | 0.1 | | | | |
| Oleylcetyl alcohol ethoxylate having about 5 EO | | | | | | | | | | | 0.1 | 0.1 | 0.1 | |
| Mixture of anionic and nonionic surfactants | | | | | | | | | | | | | 0.1 | |

It may be seen from Table 2 how good the removal properties of the various surfactant combinations were, rated with respect to the silicone test contamination under the conditions described. In this, the removal properties have been expressed in the percentage content of the amount of test contamination which could be removed.

TABLE 2

Silicone-removing power in % using various surfactant components in 0.5% aqueous NaOH solution

| Example formulation no. | Removal properties in % |
|---|---|
| V1 | 3.1 |
| V2 | 16.0 |
| V3 | 13.2 |

TABLE 2-continued

Silicone-removing power in % using various surfactant components in 0.5% aqueous NaOH solution

| Example formulation no. | Removal properties in % |
|---|---|
| 1 | 67.8 |
| 2 | 66.7 |
| 3 | 50.0 |
| 4 | 33.3 |
| 5 | 71.9 |
| 6 | 47.6 |
| 7 | 78.3 |
| 8 | 63.5 |
| 9 | 57.5 |
| 10 | 49.3 |
| 11 | 47.0 |

It may thus be seen from Table 2 that outstanding silicone-removing values may be achieved by using the surfactant compositions to be used according to the present invention in alkaline solutions.

In a second series of experiments several cleaning solutions were prepared using various surfactant compositions in combination with various complexing agents, oxidizing agents and/or solubilizing agents and the silicone-removing properties were investigated with the aid of the standard experiment already described.

The combinations used for the preparation of the cleaning solutions and how these performed in the corresponding removal experiment may be seen from Table 3.

Summarizing, it may be seen from Table 3 that which surfactants are used for the cleaning is decisive for the removal properties with respect to silicone.

It may furthermore be seen that the removing power with respect to silicone residues may be substantially improved further by addition of hydrogen peroxide.

TABLE 3

Combinations for investigations with respect to silicone-removing properties and results

| Components | No. of the formulation 1 | 2 | 3 | 4 | 5 | 6 | 7 |
|---|---|---|---|---|---|---|---|
| Fatty alcohol ethoxylate-propoxylate having 2 EO and 4 PO and $C_{12-14}$ in the alkyl group | | | 0.075 | | 0.05 | 0.1 | 0.1 |
| Fatty alcohol ethoxylate having 5 EO (emulsifier) | | | | | | 0.05 | 0.05 |
| Fatty alcohol ethoxylate having 30 EO and tallow in the alkyl group | | | | | | 0.05 | 0.05 |
| Fatty amine | | | 0.15 | | 0.1 | | |
| Coconut fatty amine having 12 EO | | | | 0.15 | 0.15 | 0.1 | 0.2 |
| Fatty alcohol ethoxylate butyl ether having 9 EO and $C_{12}$–$C_{18}$ in the the alkyl group | | | 0.255 | | 0.17 | | |
| Triethanolamine | | | | 0.21 | 0.21 | | 0.14 |
| Gluconic acid | | | 0.06 | | 0.04 | | |
| Caprylic acid | | | | 0.21 | 0.21 | | 0.14 |
| Butyldiglycol | | | | | | 0.05 | 0.05 |
| Fatty alcohol ethoxylate-propoxylate having 5 EO and 4 PO and $C_{12-14}$ in the alkyl group | | | | 0.45 | 0.45 | 0.1 | 0.4 |
| Fatty alcohol ethoxylate having 4 EO and $C_{12-14}$ in the alkyl group | | | | | | 0.05 | 0.05 |
| Sodium hydroxide | 0.5 | 5 | 0.625 | 0.24 | 0.24 | 0.5 | 0.16 |
| Hydrogen peroxide | | | | 0.35 | 0.35 | 0.35 | 0.35 |
| Phosphonates | | | 0.282 | 0.09 | 0.27 | 0.1 | 0.11 |
| NTA = nitrilotriacetic acid | | | 0.12 | | | 0.1 | |
| Demineralized water | | | Remainder to 100% | | | | |
| Result in the silicone removal experiment in % | 15 | 26 | 3.8 | 39.5 | 47.7 | 99.4 | 98.8 |

What is claimed is:

1. A method of removing silicone-containing residues from a surface comprising contacting a surfactant cleaning solution with a surface to be cleaned, the cleaning solution comprising a hydrophilic component, the hydrophilic component comprising:

a) at least one non-ionic surfactant having a general formula (I)

$$R^1—(OC_2H_4)_n—OH \quad (I)$$

in which $R^1$ is a straight-chain or branched alkyl or alkenyl radical having from 8 to 22 carbon atoms and a mean degree of ethoxylation n is from 14 to 40;

b) at least one non-ionic surfactant having a general formula (III)

$$R^3—(OC_2H_4)_r—OH \quad (III)$$

in which $R^3$ is a straight-chain or branched alkyl or alkenyl radical having from 8 to 22 carbon atoms and a mean degree of ethoxylation r is from 1 to 7;

and c) at least one nonionic surfactant having a general formula (II)

$$\begin{array}{l} R^2—N—(OC_2H_4)_x—Z_x \\ \quad\quad\;\; | \\ \quad\quad (OC_2H_4)_y—Z_y \end{array} \quad (II)$$

in which $R^2$ is a straight-chain or branched alkyl or alkenyl radical having from 8 to 22 carbon atoms, $Z_x$ and $Z_y$ are hydroxyl groups, and a mean degree of ethoxylation (x+y) is from 5 to 25, wherein, when x or y is 0, the corresponding $Z_x$ or $Z_y$ is H.

2. The method claimed in claim 1, wherein, in the hydrophilic component, based on the hydrophilic component as a whole, the sum of components a) and c) accounts for a total of from 0.1 to 33 wt. % and component b) accounts for a total of from 0.1 to 67 wt %.

3. The method claimed in claim 1, wherein the cleaning solution further comprises water and/or auxiliary substances and/or active substances.

4. The method claimed in claim 1, wherein the at least one non-ionic surfactant according to formula (I) has a mean degree of ethoxylation n of from 25 to 35 and the at least one non-ionic surfactant according to formula (II) has a mean degree of ethoxylation (x+y) of from 8 to 14 and/or the radicals $R^1$, $R^2$, $R^3$, where present, are independently of one another straight-chain or branched alkyl or alkenyl radicals having from 12 to 18 carbon atoms.

5. The method claimed in claim 1, wherein the weight ratio of (a+c):(b) in the cleaning solution is from 4:1 to 1:8.

6. The method claimed in claim 1, wherein the cleaning solution further comprises additional components having complex-forming properties and/or solubilizing agents and/or surface-active components.

7. The method claimed in claim 1, wherein the cleaning solution is in the form of a gel, emulsion, paste, dispersion, solid shaped body, or powder.

8. The method claimed in claim 1, wherein the step of removing silicone-containing residues from a surface comprises contacting the cleaning solution with the surface to be cleaned in concentrated or dilute form by an immersion process or by filling an article to be cleaned and/or by means of application aids.

9. The method claimed in claim 1, wherein the cleaning solution further comprises water in a dilution factor of from 1:5 to 1:10,000.

10. The method claimed in claim 9, wherein the cleaning solution comprises auxiliary substances and/or active substances.

11. The method claimed in claim 9, wherein the cleaning solution, based on the cleaning solution as a whole, contains a) 0.00001 to 6.5 wt. % of components a) plus c), and 0.00001 to 13 wt. % of component b), and b) from 0.05 to 10 wt. % of alkali hydroxide, and c) from 0.03 to 5 wt. % of agents having complex-forming properties.

12. The method claimed in claim 11, wherein the cleaning solution further comprises from 0.03 to 5 wt. % of solubilizing agents.

13. The method claimed in claim 11, wherein the cleaning solution further comprises further low-foam surfactants.

14. The method claimed in claim 1, wherein the step of removing silicone-containing residues from a surface comprises circulating and/or spraying the cleaning solution manually or in an automatic system, at a use temperature of 0 to 80° C. and circulating and/or spraying times being from 5 to 60 minutes.

15. The method claimed in claim 14, wherein the step of removing silicone-containing residues from a surface comprises disinfecting the surface and rinsing the surface with water of drinking quality.

16. The method claimed in claim 1, wherein the cleaning solution further comprises hydrogen peroxide.

* * * * *